US006862971B2

(12) United States Patent
Ramkumar

(10) Patent No.: US 6,862,971 B2
(45) Date of Patent: Mar. 8, 2005

(54) BALLISTIC PROTECTION COMPOSITE SHIELD AND METHOD OF MANUFACTURING

(75) Inventor: Seshadri S. Ramkumar, Austin, TX (US)

(73) Assignee: Texas Tech University, Lubbock, TX (US)

( * ) Notice: Subject to any disclaimer, the term of this patent is extended or adjusted under 35 U.S.C. 154(b) by 66 days.

(21) Appl. No.: 10/322,380

(22) Filed: Dec. 17, 2002

(65) Prior Publication Data

US 2004/0112206 A1 Jun. 17, 2004

(51) Int. Cl.[7] ..... F41H 5/02
(52) U.S. Cl. ..... 89/36.02; 428/911; 2/2.5
(58) Field of Search ..... 89/36.02, 36.05; 428/911; 2/2.5

(56) References Cited

U.S. PATENT DOCUMENTS

| | | | | | |
|---|---|---|---|---|---|
| 3,641,638 | A | * | 2/1972 | Laible | 28/112 |
| 3,971,072 | A | * | 7/1976 | Armellino | 2/2.5 |
| 5,316,820 | A | * | 5/1994 | Harpell et al. | 428/109 |
| 5,343,796 | A | * | 9/1994 | Cordova et al. | 89/36.02 |
| 5,536,553 | A | * | 7/1996 | Coppage et al. | 428/102 |
| 5,591,933 | A | * | 1/1997 | Li et al. | 89/36.02 |
| 5,699,596 | A | | 12/1997 | Fehrer | |
| 5,796,028 | A | | 8/1998 | Field et al. | |
| 5,800,749 | A | * | 9/1998 | Lewit et al. | 264/46.4 |
| 5,813,101 | A | | 9/1998 | Fehrer | |

(List continued on next page.)

FOREIGN PATENT DOCUMENTS

WO WO9421450 * 9/1994

WO WO 02/29376 A1 4/2002

OTHER PUBLICATIONS

"Needle Punched Nonwovens", Feb. 1998, Praveen Jana and Xinli Liu.*

Textile News, "Texas Tech to be first in U.S. to house Fehrer needle loom", May 2001, author unknown.*

Technical Paper—Needlepunching: A Unique Sector, Dec. 1998, John Foster.*

INJ Researcher'Toolbox: Nonwoven Processing Equipment at Texas Tech, Summer 2001.*

U.S. Dept. of Justice, Office of Justice Programs, "Selection and Application Guide to Personal Body Armor," pp. 36–38, Nov., 2001, The National Institute of Justice's National Law Enforcement and Corrections Technology Center, Rockville, MD.

S.S. Ramkumar and A.P.S. Sawhney, "Production of Cotton Nonwoven Fabrics Using H1 Technology Needleloom," pp. 674–676, National Cotton Council, Memphis, TN.

Spectra Shield Technology: A Revolution in Armor, Spectra Performance Fiber, http://www.spectrafiber.com/products/fr_shield.html, 1 page, accessed Sep. 30, 2003.

(List continued on next page.)

*Primary Examiner*—Troy Chambers
(74) *Attorney, Agent, or Firm*—Hulsey, Grether + Fortkort, LLP; Aaron A. Weiss

(57) ABSTRACT

A ballistic protection composite shield is disclosed, with improved next-to-skin properties, and improved flexibility. Needlepunching technology permits the manufacture of the wear layer using any type of fiber, and advantageously allows distinct layering, fiber blending, compressibility, controlled fiber orientation, and increases z-directional strength. Needlepunching the nonwoven wear layer to the woven antiballistic layer mechanically interconnects the two layers, eliminating the need for an adhesive bond and increasing the flexibility of the shield. An abrasion resistant strike layer, such as leather, increases the life of the shield.

4 Claims, 4 Drawing Sheets

U.S. PATENT DOCUMENTS

| | | | | | |
|---|---|---|---|---|---|
| 6,012,162 | A | | 1/2000 | Bullat | |
| 6,026,510 | A | | 2/2000 | Kocher | |
| 6,029,270 | A | | 2/2000 | Ost et al. | |
| 6,047,399 | A | | 4/2000 | Bachner, Jr. | |
| 6,098,196 | A | | 8/2000 | Logan | |
| 6,103,641 | A | | 8/2000 | Gehring, Jr. | |
| 6,119,575 | A | | 9/2000 | Dragone et al. | |
| 6,127,291 | A | * | 10/2000 | Coppage et al. | 442/135 |
| 6,151,710 | A | | 11/2000 | Bachner, Jr. | |
| 6,195,798 | B1 | | 3/2001 | Bachner, Jr. | |
| 6,219,842 | B1 | | 4/2001 | Bachner, Jr. | |
| 6,281,149 | B1 | * | 8/2001 | Hussein et al. | 442/239 |
| 6,397,672 | B1 | | 6/2002 | Ramkumar | |
| 6,562,435 | B1 | * | 5/2003 | Brillhart et al. | 428/105 |
| 2001/0015222 | A1 | * | 8/2001 | Lewit et al. | 137/2 |
| 2002/0069444 | A1 | * | 6/2002 | Graham et al. | 2/2.5 |
| 2003/0008584 | A1 | * | 1/2003 | Thomas | 442/240 |
| 2003/0022583 | A1 | * | 1/2003 | Thomas et al. | 442/403 |

OTHER PUBLICATIONS

Dr. Ernst Fehrer, H1 Technology—A New Approach to Needling, ITB Nonwovens, Industrial Textiles, Jan. 2000, Reprint pp. 1–4.

Dr. Seshadri S. Ramkumar et al., Woven Fabric Composites, for Bodily Protection Systems, Industrial Fabrics Bulletin, No. 2, Jun. 2002, pp. 16–19.

Fehrer AG Online, H1 Technology, 2 pages, http://www.fehrerag.com/Fehrer/Product/HITec02.htm, accessed Oct. 14, 2003.

Dr. Seshadri s. Ramkumar, Developments in nonwovens technology: current scenario, Textile Technology, ATA Journal, p. 59.

Spectra Fiber: Product Information, Spectra Performance Fiber, http://www.spectrafiber.com/products/fr_spectra.html, 1 page, accessed Oct. 14, 2003.

* cited by examiner

BALLISTIC PROTECTION COMPOSITE SHIELD AND METHOD OF MANUFACTURING

BACKGROUND OF THE INVENTION

1. Field of the Invention

The present invention relates generally to the field of ballistic protection shields. More particularly, the present application relates to an improved ballistic protection composite shield and an improved method for manufacturing a ballistic protection composite shield.

2. Description of Related Art

It is common for today's military and police personnel to use ballistic armor plates and shields to protect themselves from high velocity and high impact projectiles, such as bullets. Bullets may be Full Metal Jacketed (FMJ) characterized generally as a bullet constructed of lead covered with a copper alloy; Jacketed Soft Point (JSP) characterized generally as a bullet constructed of lead and covered with a copper alloy except for the tip of the bullet; Jacketed Hollow Point (JHP) characterized generally as having a hollow cavity or hole in the nose of the bullet and covered completely except for the hollow point; or lead, which may be alloyed with hardening agents.

The National Institute of Justice (NIJ), with the active participation of body armor manufacturers, developed performance requirements to ensure antiballistic garments provide a well defined minimum level of ballistic protection. Table 1.1 lists the different ballistic protection levels as specified by the National Institute of Justice (NIJ Standard—0101.04).

TABLE 1

NIJ Standard 0101.04

| | Test Variables | | | | Performance Index |
|---|---|---|---|---|---|
| Armor Type | Test Round | Test Ammunition | Nominal Bullet Mass | Minimum Bullet Velocity | Maximum Depth of Penetration |
| I | 1 | .22 caliber LR LRN | 2.6 g 40 gr | 329 m/s (1080 ft/s) | 44 mm (1.73 in) |
| | 2 | .380 ACP FMJ RN | 6.2 g 95 gr | 322 m/s (1055 ft/s) | 44 mm (1.73 in) |
| II-A | 1 | 9 mm FMJ RN | 8.0 g 124 gr | 341 m/s (1120 ft/s) | 44 mm (1.73 in) |
| | 2 | .40 S&W FMJ | 11.7 g 180 gr | 322 m/s (1055 ft/s) | 44 mm (1.73 in) |
| II | 1 | 9 mm FMJ RN | 8.0 g 124 gr | 367 m/s (1205 ft/s) | 44 mm (1.73 in) |
| | 2 | .357 Mag JSP | 10.2 g 158 gr | 436 m/s (1430 ft/s) | 44 mm (1.73 in) |
| III-A | 1 | 9 mm FMJ RN | 8.2 g 124 gr | 436 m/s (1430 ft/s) | 44 mm (1.73 in) |
| | 2 | .44 Mag SJHP | 15.6 g 240 gr | 436 m/s (1430 ft/s) | 44 mm (1.73 in) |
| III | — | 7.62 mm NATO FMJ | 9.6 g 148 gr | 847 m/s (2780 ft/s) | 44 mm (1.73 in) |
| IV | — | .30 caliber M2 AP | 10.8 g 166 gr | 878 m/s (2880 ft/s) | 44 mm (1.73 in) |

High performance fibers such as Kevlar® and Nomex®, manufactured by DuPont, Twaron®, manufactured by Teijin Twaron, Dyneema®, manufactured by Toyobo, and Spectra®, manufactured by AlliedSignal, and metals such as steel and copper have been used for applications in ballistic protection clothing. Even materials such as cotton, silk, wool, and leather have been used in the development of ballistic protection shields, although these materials conventionally provide minimal protection, and have instead been used for physical comfort.

However, as bullet velocities increase, the thickness of ballistic protection shields must also increase. As the thickness increases, there is generally a reduction in flexibility of the ballistic protection shield and a decrease in comfort for a user wearing the ballistic protection shield. Presently, the technical textile industry is motivated to perform basic and applied research to develop stronger and lighter ballistic clothing capable of protecting the wearer from projectiles. It is therefore desirable to provide a ballistic protection shield that is flexible.

It is further desirable to provide a ballistic protection garment with a next to skin layer, also referred to as a wear layer, which is comfortable for the user to wear against skin.

It is further desirable to provide a ballistic protection shield with abrasion resistant properties on the surface that an incoming bullet would contact first, also referred to as a strike surface.

It is further desirable to provide a protective garment manufacturing method that is faster than prior art methods.

It is further desirable to provide a protective garment manufacturing method that may be used with any type of fiber in the wear layer.

It is further desirable to provide a protective garment manufacturing method that may be used with any type of fiber in the ballistic panel.

BRIEF SUMMARY OF THE INVENTION

The present invention overcomes the shortcomings of prior art ballistic protection shields with a ballistic protection composite shield and a method for manufacturing the same. Embodiments of the present invention provide a method for manufacturing a ballistic protection shield by interconnecting a nonwoven next-to-skin layer (a wear layer) to a layer or multiple layers of anti-ballistic materials, and bonding the antiballistic layer to an abrasion resistant layer. The abrasion resistant layer may be leather.

In one broad respect, the present invention is directed to a method for manufacturing a ballistic protection composite shield, using the steps of mechanically interconnecting a nonwoven wear layer to one or multiple antiballistic layers using needlepunching technology, and bonding, using an adhesive, the antiballistic layers to an abrasion resistant strike layer.

In another broad respect, the present invention is directed to a method for manufacturing a ballistic protection composite shield, using the steps of manufacturing a nonwoven wear layer with selected next-to-skin properties; mechanically interconnecting, using, for example H1 technology, one or more woven antiballistic layers to the nonwoven wear layer using needle punching technology; and bonding an abrasion resistant layer to the one or more woven antiballistic layers. The method may further include stitching the ballistic protection composite shield. Manufacturing a nonwoven wear layer may include needlepunching, using for example H1 technology, at least one layer with selected properties. The abrasion resistant layer, which may be manufactured from leather, may be adhesively bonded to the woven antiballistic layers.

In another broad respect, the present invention is directed to a ballistic protection composite shield having a nonwoven wear layer with at least one layer of at least one material having selected properties; a woven antiballistic layer (comprising a plurality of sheets of woven antiballistic material) mechanically interconnected to the nonwoven wear layer, and an abrasion resistant layer bonded to the woven antiballistic layer. The ballistic protection shield may have stitching to define a selected model. The ballistic abrasion resistant layer may be leather. In some embodiments, the nonwoven wear layer may be manufactured using needlepunching technology, such as H1 needlepunching technology. The mechanical interconnection between said nonwoven wear layer and said woven antiballistic layer comprises needlepunching technology, such as H1 needlepunching technology.

BRIEF DESCRIPTION OF THE DRAWINGS

The following drawings form part of the present specification and are included to further demonstrate certain aspects of the present invention. The figures are not necessarily drawn to scale. The invention may be better understood by reference to one or more of these drawings in combination with the detailed description of specific embodiments presented herein.

DETAILED DESCRIPTION OF PREFERRED EMBODIMENTS

The present invention overcomes the shortcomings of the prior art with a ballistic protection composite shield and method for manufacturing the same. Embodiments of the present invention provide a new and faster method of mechanically interconnecting a nonwoven wear layer made from apparel grade fibers, to a ballistic panel, using needlepunching technology.

Any element in a claim that does not explicitly state "means for" performing a specified function, or "step for" performing a specific function, is not to be interpreted as a "means" or "step" clause as specified in 35 U.S.C. § 112, ¶ 6. In particular, the use of "step of" in the claims herein is not intended to invoke the provision of 35 U.S.C. § 112, ¶ 6.

Figure 1:
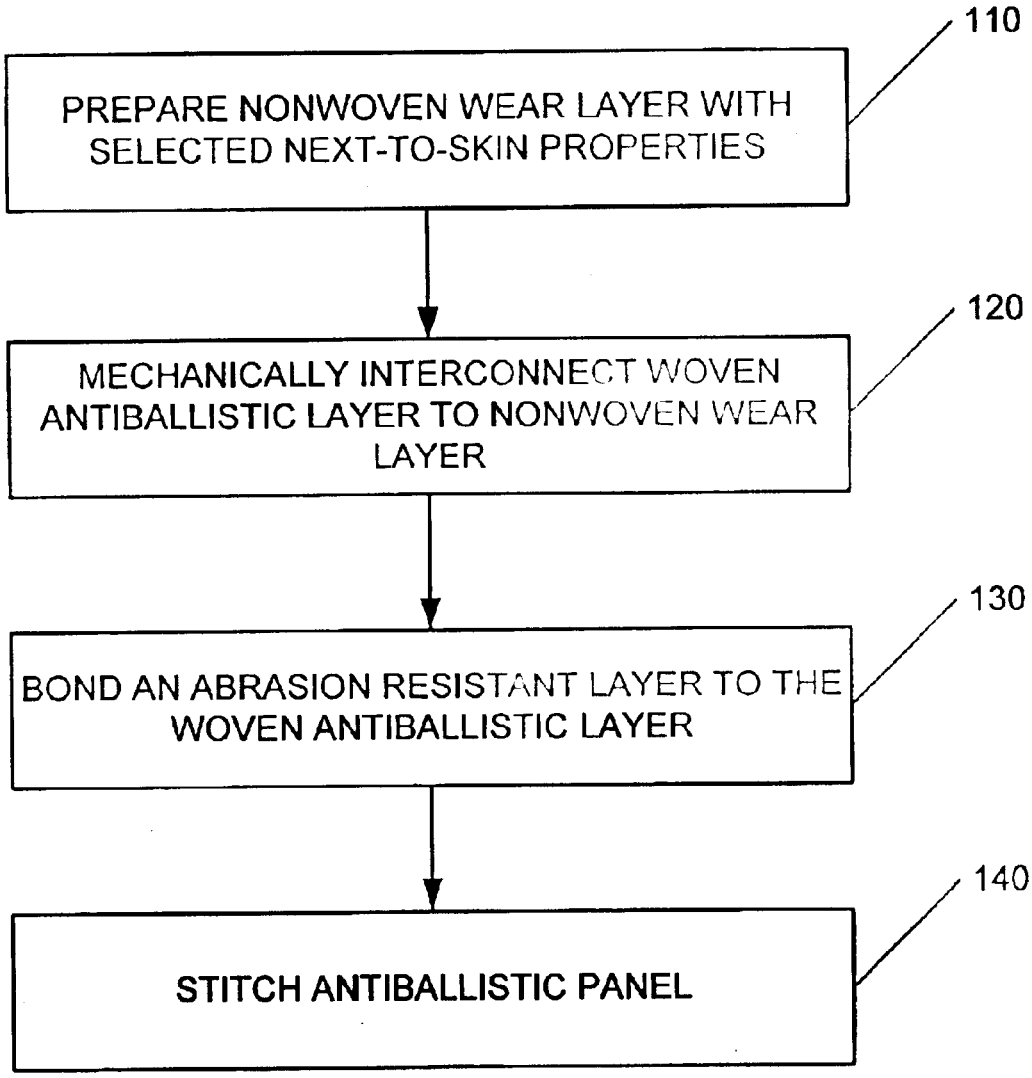
FIG. 1 shows a flowchart of a method for manufacturing a protective composite shield, in accordance with one embodiment of the present invention.

FIG. 1 is a flowchart of a method for manufacturing a ballistic protection composite shield, in accordance with one embodiment of the present invention.

In step 110, a wear layer, also referred to as a next-to-skin layer, is prepared using needlepunching technology. Needlepunching is an entangling, bonding, and compacting process that involves the precise action of thousands of barbed needles to physically interconnect fibers. Fibers generally include both natural and man made substances, with a high length to weight ratio, and with suitable characteristics for being processed into a fabric. Needlepunching technology is versatile and allows the use of both natural and synthetic fibers to be processed. Needlepunching the nonwoven wear layer results in improved next-to-skin properties for the nonwoven wear layer, in which the next-to-skin properties include any property relating to the comfort of a wearer. For example, the nonwoven wear layer may wick moisture away from the skin, breathe, eliminate or reduce odors, assist in cooling the wearer, assist in warning the user, or have other selected properties that contribute to the overall comfort of the person wearing the garment.

Figure 2:
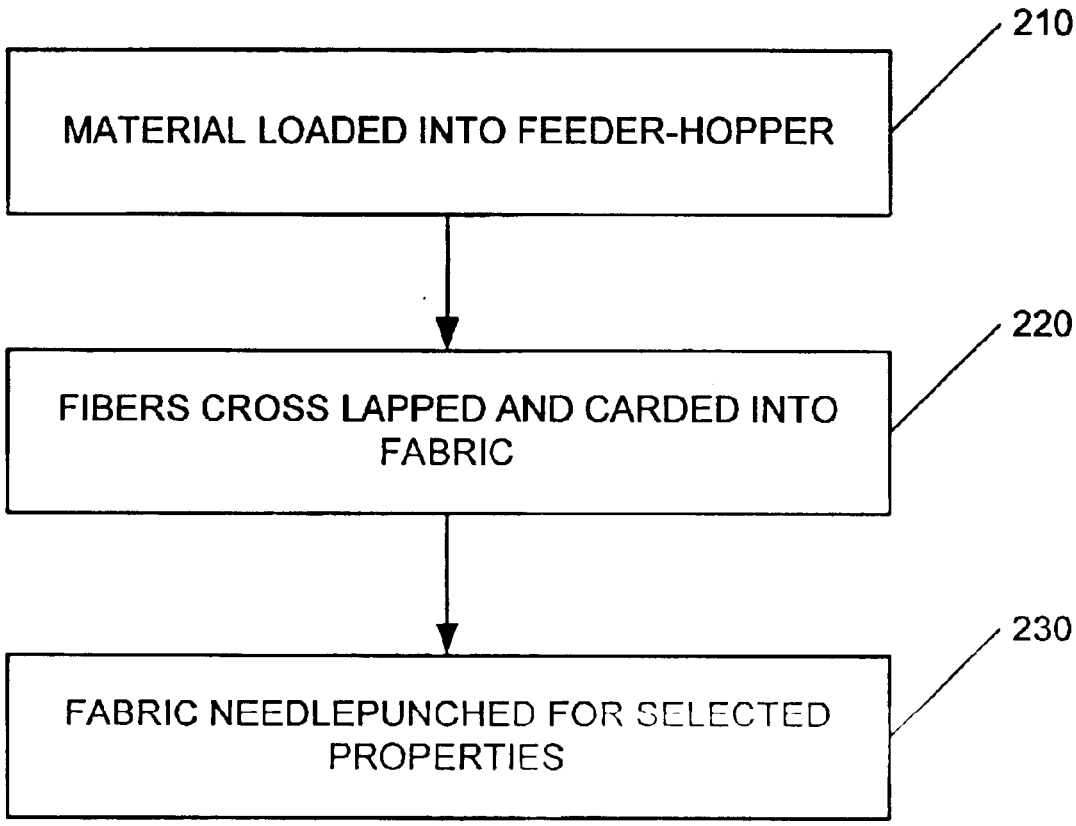
FIG. 2 shows a flowchart of a method for manufacturing a skin compatible nonwoven wear layer for use in a ballistic protection shield, in accordance with one embodiment of the present invention.

FIG. 2 is a flowchart of the steps used to create a needlepunched nonwoven wear layer.

In step 210, the material is loaded into a hopper-feeder.

In step 220, the fibers are cross lapped and carded. For example, a first fiber may be cross lapped and carded into a first fabric, and a second fiber may be cross lapped and carded into a second fabric. The first and second fabrics may then be needlepunched in step 230 to form a bi-component layer possessing two distinct fiber layers. This distinct layering, in which two or more layers of distinct fiber types are blended into one composite, is an advantage of needlepunching technology, and may be used with lightweight woven fabrics, films, and other fabric forms such as nonwovens without departing from the present invention. Needlepunched materials advantageously possess several other properties, such as controlled fiber orientation, z-directional strength, fiber blending, and compressibility.

Controlled fiber orientation describes the ability for fibers to be oriented in the machine direction, the cross machine direction, or at any intermediate orientation.

Z-directional strength relates to the shear strength of a material. Needlepunched materials possess a higher Z-directional strength for improved shear strength and a reduction in the potential for ply delamination.

The fiber blending provided by needlepunching offers the ability for diverse fibers or fibers with varying properties, deniers, lengths, or a combination to be intermingled during the needlepunching process to create materials with selective properties. For example, fibers with high strength may be interconnected with thermoplastic fibers to create a unique material. Distinct layering means two or more layers of distinct fiber types may be layered into one composite. Compressibility of the composite facilitates molding or shaping the material into intricate designs and structural patterns.

In a preferred embodiment, a "state-of-the-art" H1 technology needlepunching nonwoven machinery, a technology developed by Dr. Ernst Fehrer of Fehrer, AG, has been effectively utilized to develop the base nonwoven substrates.

In step 120, the nonwoven wear layer prepared in step 110 is interconnected or otherwise mechanically attached to the woven antiballistic layer. In preferred embodiments, the step 120 comprises needlepunching the nonwoven wear layer to the woven antiballistic layer. Advantageously, using a mechanical attachment process improves the flexibility of the construction by eliminating the need for an adhesive bond generally found in antiballistic garments. It will be apparent to those skilled in the art that improving the flexibility of the garment without sacrificing the antiballistic properties of the garment is an advantage over prior art constructions.

Figure 3:
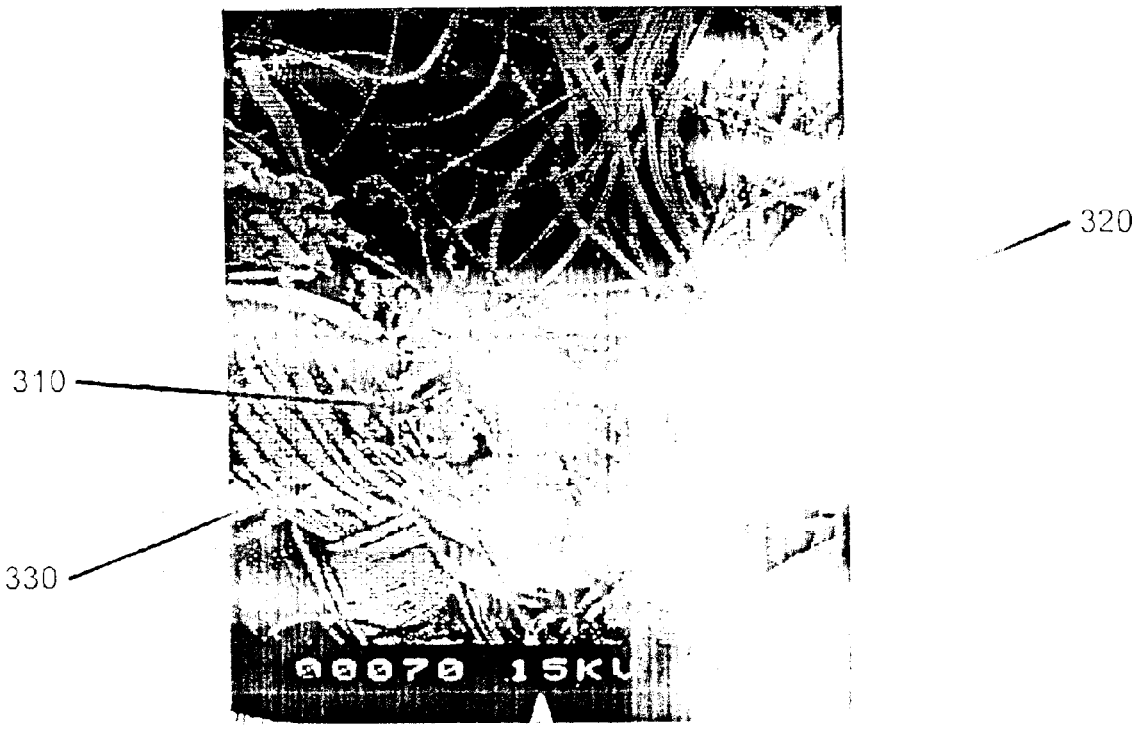
FIG. 3 is a magnified photograph of the mechanical connection between the nonwoven material and the woven antiballistic material, in accordance with one embodiment of the present invention.

FIG. 3 is a magnified photograph of the mechanical interconnection 310 between the nonwoven wear layer 320 and the woven antiballistic layer 330. In FIG. 3, the nonwoven layer 320 comprises Dacron®, manufactured by DuPont, and the woven antiballistic layer 330 comprises Spectra®, manufactured by Honeywell, Inc. However, the present invention is not limited to use with only Dacron® and Spectra®, but may be used with any suitable type of fiber for the nonwoven layer and any suitable type of material for the woven layer to produce selected properties for the ballistic protection shield.

In step 130, an abrasion resistant layer is bonded to the composite layer comprising the nonwoven wear layer and the woven antiballistic layer, thereby forming a ballistic panel. In some embodiments, a leather layer provides the desired abrasion resistance for the abrasion resistant layer. In a preferred embodiment, Hi-Strength 90® adhesive, manufactured by 3M, bonds the leather layer to the antiballistic/wear layer composite.

In step 140, the ballistic panel is stitched. It will be apparent to those of skill in the art that differences in stitching a ballistic panel may result in manufacturing different models for purposes of NU ballistic standards, without departing in scope from the present invention.

Figure 4:
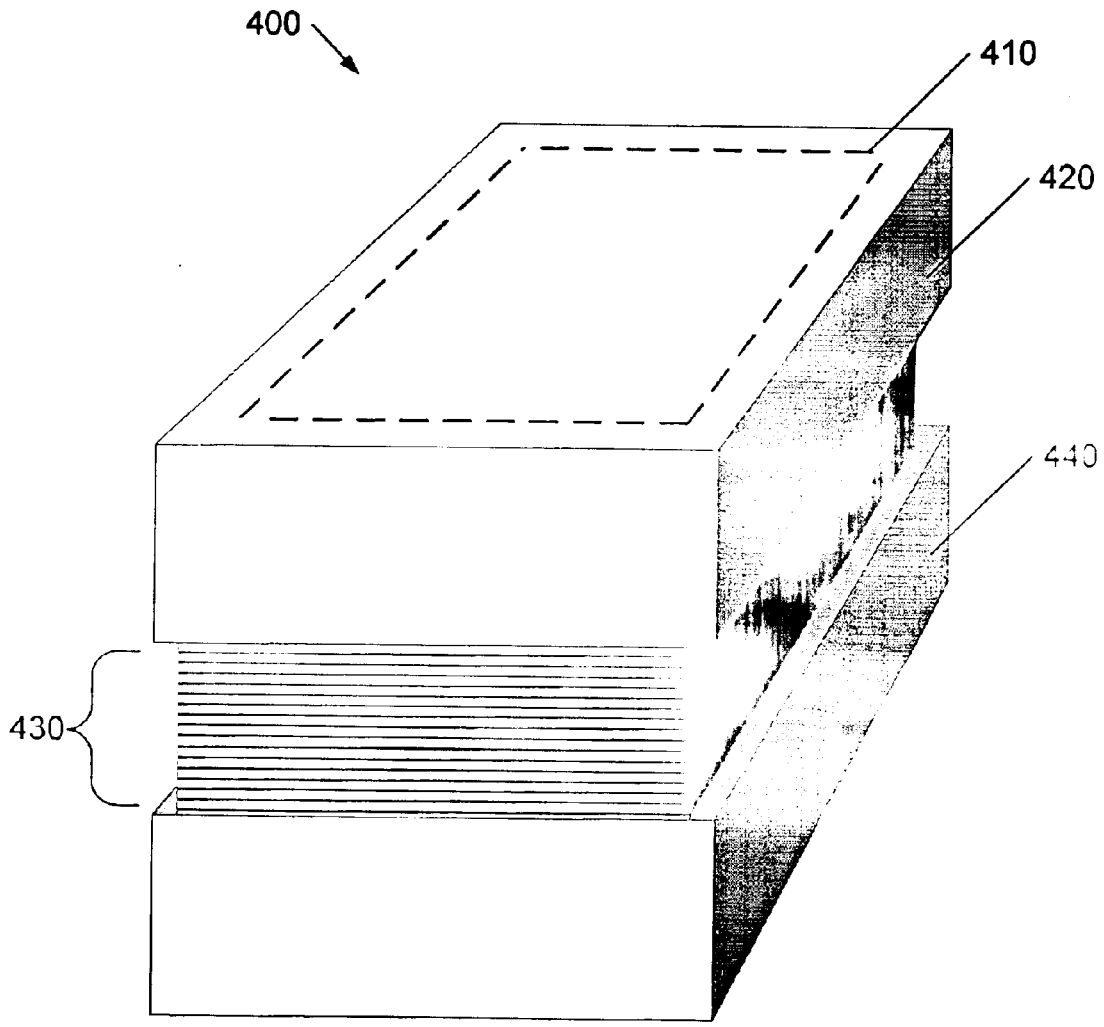
FIG. 4 shows a simple perspective view of a ballistic protection composite shield in accordance with one embodiment of the present invention.

FIG. 4 is a simple perspective view of a leather based ballistic protection composite shield 400 according to one embodiment of the present invention. The shield comprises a nonwoven layer 440, an antiballistic layer 430 comprising one or more layers of fabric adapted to provide ballistic protection, a leather layer 420 and stitching 410. In addition to using needlepunching technology and adhesives to bond the various layers together, the present invention may comprise stitching to strengthen the overall construction.

An analysis of the test results indicates that a protective composite shield comprising manufactured by the method described above, which has twenty three (23) layers of Spectra® fabric in the antiballistic layer, a Dacron® wear layer for improved next-to-skin properties, and a strike layer manufactured from smooth-grained, chromium tanned, one-sided finish bovine leather with a garment weight of 1.75 ounces per foot, provides sufficient ballistic performance necessary to achieve Level II-A protection.

Table 2 contains details of a sample of broad woven Spectra® Fabric used in the manufacture of a preferred embodiment.

TABLE 2

| | |
|---|---|
| Material | Spectra ® 1000 |
| Warp Count | 215 denier |
| Fill Count | 215 denier |
| Fabric Style | Plain |
| Ends/Inch | 56 |
| Fillings/Inch | 56 |
| Fabric Weight | 112 g/m$^2$ |
| Fabric Thickness | 0.18 mm |

Table 3 contains information about the Dacron® sample used in the preparation of the test sample for a preferred embodiment.

TABLE 3

| Property | Denier per Filament (Decitex) | Elongation (Breaking) % | Tenacity (Breaking) gf/d (cN/tex) | Rope Base Average Crimps/in. (crimps/cm) | Staple Length In. (mm) |
|---|---|---|---|---|---|
| Nominal Value | 1.5 (38.1) | 52.0 | 4.7 (41.45) | 14.2 (5.59) | 1.5 (38.1) |

The foregoing examples are included to demonstrate various possible embodiments of the present invention. It will be appreciated by those of skill in the art that further variations of the illustrated designs are possible within the spirit and scope of the present invention. For example, other techniques of needlepunching technology may be used to provide different selected next-to-skin properties. Additionally, the strike layer may be tanned using different technology to provide varying degrees of abrasion resistance, or may be manufactured from suede or a synthetic leather. These and other variations will be apparent to those skilled in the art in view of the above disclosure and are within the spirit and scope of the invention.

As used in this specification and in the appended claims, it should be understood that the word "a" does not preclude the presence of a plurality of elements accomplishing the same function.

What is claimed is:

1. A method for manufacturing an antiballistic composite shield that has improved flexibility and next-to-skin comfort properties while still providing ballistic protection to its wearer, the method comprising the steps of:

manufacturing a nonwoven wear layer by needle punching fibers, including apparel-grade fibers, in order to produce the wear layer having significant next-to-skin properties for the comfort of the wearer;

needle punching a first woven antiballistic layer to the wear layer in order to mechanically interconnect the layers;

bonding a plurality of woven antiballistic layers to the first antiballistic layer after needle punching the first woven antiballistic layer to the wear layer, and bonding an abrasion-resistant layer to at least one of the plurality of antiballistic layers.

2. The method of claim 1, further comprising the step of stitching the antiballistic composite shield.

3. The method of claim 1, wherein the step of bonding an abrasion-resistant layer to at least one of the plurality of antiballistic layers comprises the step of:

adhesively bonding an abrasion-resistant layer to at least one of the plurality of antiballistic layers.

4. The method of claim 1, wherein the step of bonding the abrasion-resistant layer to at least one of the plurality of antiballistic layers comprises the step of:

bonding a leather layer to at least one of the plurality of antiballistic layers.

* * * * *